United States Patent [19]

Gil et al.

[11] Patent Number: 4,710,347

[45] Date of Patent: Dec. 1, 1987

[54] MARAGING STEEL HAVING HIGH STRENGTH AND HIGH TOUGHNESS

[75] Inventors: Kim Y. Gil; Lee C. Sun, both of Seoul, Rep. of Korea

[73] Assignee: Korea Advanced Institute of Science and Technology, Seoul, Rep. of Korea

[21] Appl. No.: 868,594

[22] Filed: May 30, 1986

[30] Foreign Application Priority Data

Oct. 12, 1985 [KR] Rep. of Korea ..... 7505

[51] Int. Cl.[4] ..... C22C 38/44

[52] U.S. Cl. ..... 420/94; 420/103; 420/122; 420/126

[58] Field of Search ..... 420/94, 103, 122; 148/336, 12.3, 328

[56] References Cited

U.S. PATENT DOCUMENTS 3,728,196 3/1973 Murphy et al. ..... 148/328

*Primary Examiner*—L. Dewayne Rutledge
*Assistant Examiner*—Deborah Yee
*Attorney, Agent, or Firm*—Birch, Stewart, Kolasch & Birch

[57] ABSTRACT

Cobalt-free maraging steels consist essentially of 15% to 25% nickel, 2% to 8% tungsten, 0.5% to 2.0% titanium, 0.05% to 0.3% aluminum, and the balance iron so that the maraging steels exhibit a yield strength in the range of 240,000 Psi (1656 Mpa) to 265,000 Psi (1826 Mpa) and a Charpy impact energy of about 25 joules.

1 Claim, 3 Drawing Figures

MARAGING STEEL HAVING HIGH STRENGTH AND HIGH TOUGHNESS

BACKGROUND OF THE INVENTION

The present invention relates to a tungsten-containing maraging steel having high strength and high toughness.

Conventional maraging steels contain 18% nickel, 8% cobalt, 4% molybdenum, 0.4Ti and 0.1% aluminum. As the content of titanium in such maraging steels changes from 0.2% to 0.7%, the yield strength varies from 1400 Mpa to 2100 Mpa. From the 1970s, the supply of cobalt, strategic element became insufficient, thereby causing cobalt to be expensive. As a result, it is needed to provide a maraging steel of new composition.

The story of the development of, the applied field, and the advantages of maraging steel are summarily disclosed in an introduction "Notes on the Development of Maraging Steels" of "Source Book on Maraging Steels" edited by R. F. Decker and published by ASM, in 1979. This reference taught that maraging steel is a special alloy exhibiting high strength and high toughness and being used in the aeronautic industry, the precision machinery industry, the precision mold industry, and the defense industry. As the alloy is air-cooled after the solid solution treatment, a matrix structure of massive martensite having high toughness can be obtained. After the aging, substitutional type alloying elements, that is, nickel, molybdenum, tungsten,, and titanum, which are supersaturated in the matrix structure of the alloy, forms such precipitations as $Ni_3Mo$, $Ni_3W$, and $Ni_3Ti$. These precipitations contribute to the achievement of high strength. On the other hand, high toughness can be obtained, as carbon in the alloy is maintained in an amount no more than 0.03%.

S. Floreen, etc., Trans. ASM, 57, 714-726(1964) taught that cobalt acts to reduce the solubility of the substitutional type alloying elements (nickel, molybdenum, and titanium) in the matrix structure of the alloy, and thus promotes the precipitation of $Ni_3Mo$. However, they also set force that cobalt by itself is not the constitution element of the precipitations. On the other hand, tungsten exhibits the physical property similar to that of molybdenum, in view of the fact that there is no difference of the valence electrons between both elements and that the lattice constant influencing the lattice deformation is 3.15 Å in molybdenum and 3.17 Å in tungsten.

From the above-mentioned two facts, the inventors found that it is possible to develop a new maraging steel wherein cobalt is eliminated and molybdenum is substituted by tungsten. The depreciation in the strength due to the elimination of cobalt could be compensated by increasing the content of titanum to 1.4%.

SUMMARY OF THE INVENTION

Therefore, an object of the present invention is to provide a new maraging steel having high strength and high toughness, wherein inexpensive tungsten is used as the alloying element, in place of cobalt and molybdenum used in the conventional maraging steels.

In accordance with the present invention, this object can be accomplished by providing a maraging steel having high strength and high toughness, consisting of 15% to 25% nickel, 2% to 8% tungsten, 0.5% to 2.0% titanium, 0.05% to 0.30% aluminum, and the balance iron.

To provide high toughness, tungsten-containing maraging steels should be subjected to a vacuum induction melting treatment. Thereafter, the maraging steels will be subjected to a homogenizing treatment at a temperature of 1250° C. for an hour. Then, the steels will be forged and rolled. The steels should be maintained at a temperature of 1250° C. for an hour prior to the final rolling thereof and water-cooled just after the rolling thereof to prevent the precipitation of Ti(C, N) at the grain boundary of prior austenite. Thereby, a high toughness can be obtained. It can be found that the most preferable heat treatment is for the steels to be subjected to a solid solution treatment at a temperature of 815° C. for an hour, followed by an aging treatment at a temperature of 480° C. for three hours.

DETAILED DESCRIPTION OF THE PREFERRED EMBODIMENTS

A test piece was sampled from the maraging steel treated under tha above-mentioned heat treating conditions. As a result of observing the test piece by an electron microscope, the precipitations were confirmed as $Ni_3W$ and $\eta$-$Ni_3Ti$, as shown in FIG. 1. $Ni_3W$ which is orthorhombic (a=5.08 Å, b=4.15 Å, and c=4.25 Å) is oriented in the directions of $\{011\}_M//(010)_{Ni_3W}$ and $<1\bar{1}1>_M//[100]_{Ni_3W}$ for the matrix. $Ni_3W$ has a shape of rod having the diameter of about 150 Å and the length of about 200 Å. The rod has an axis extending in a $<111\leqq$ direction of the matrix. $\eta$-$Ni_3Ti$ which is hexagonal (a=5.10 Å and c=8.30 Å) is oriented in the directions of $\{011\}_M//(0001)_{\eta\text{-}Ni_3Ti}$ and $<1\bar{1}1>_M//[11\bar{2}\,0]_{\eta\text{-}Ni_3Ti}$ for the matrix. $\eta$-$Ni_3Ti$ has a shape of plate having the thickness of about 20 Å and the length of about 150 Å.

Figure 1B:
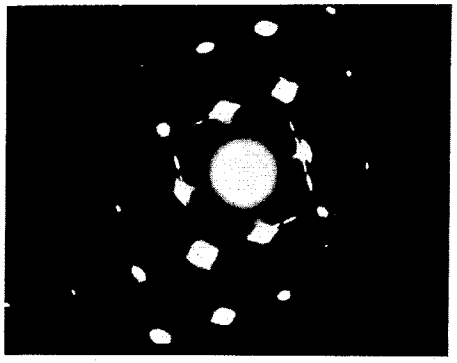
FIG. 1 is electron microscopic photographs of 4.5% tungsten-containing maraging steel subjected to a normal aging treatment, wherein "a" designates a photograph (x 150,000) showing $Ni_3W$ along with $\eta$-$Ni_3Ti$) "b" a photograph of the electron diffraction pattern, "c" a photograph (x 150,000) showing only $Ni_3W$, and "d" a photograph (x 150,000) showing only $\eta$-$Ni_3Ti$.
Figure 1D:
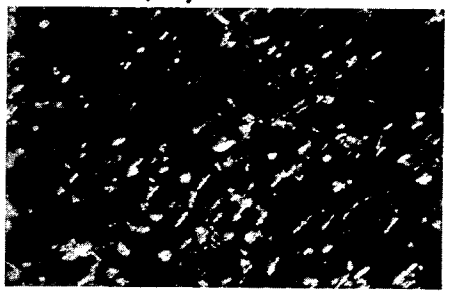
Figure 1A:
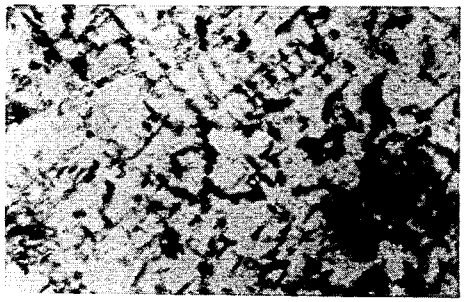
Figure 1C:
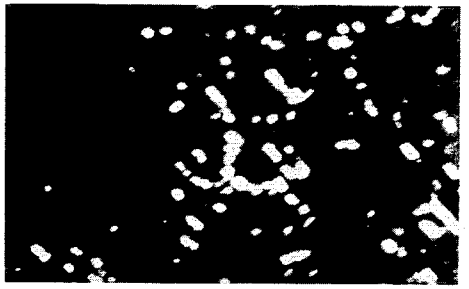
Figure 2:
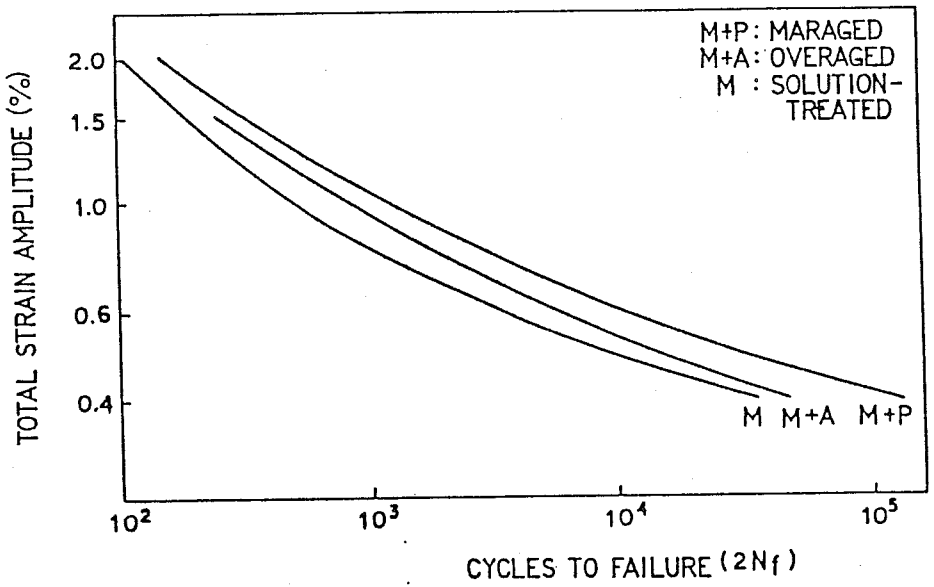
FIG. 2 is a graph showing the low cycle fatigue of 4.5% tungsten-containing maraging steel for maraged (M+P) condition.

In FIG. 2, "M" designates martensite, "P" precipitation, and "A" austenite. M is the one subjected to a solid solution treatment and not subjected to an aging treatment. The M+P is the structure in which the reverted austenite is not presented, and $Ni_3W$ and $\eta$-$Ni_3Ti$ are precipitated, as the steel is aged at a temperature of 480° C. for three hours after the solid solution treatment. The M+A is the structure in which the martensite matrix, the reverted austenite, and the precipitations are presented, as the steel is over-aged at a temperature of 650° C. for three hours after the solid solution treatment. The low cycle fatigue property of maraging steel containing 4.5% tungsten was exhibited in similar to that of conventional maraging steels.

The maraging steel which contains tungsten, in place of cobalt and molybdenum, according to the present invention has mechanical properties identical to those of conventional 250 grade-maraging steel. In virtue of the development of such maraging steel, there are effects of stably supplying the raw materials, of increasing the added value of tungsten, and of reducing the price of maraging steel.

The maraging steel of the present invention can be produced in the following manner. To provide a high toughness, tungsten-containing maraging steel has to be melted under the vacuum of $10^{-2}$ to $10^{-3}$ Torr. To this end, electrolytic iron and electrolytic nickel are put in a magnesia crucible and then melted under the vacuum. After the completion of melting electrolytic iron and electrolytic nickel, tungsten, titanium, and aluminum are additionally charged into the crucible. After the completion of melting these alloying elements, argon is blown into the crucible to degass the molten metal. Then, the molten metal is tapped out of the crucible. The produced ingot is forged, after the homogenizing treatment at a temperature of 1250° C. for an hour. Then, the forged ingot is subjected to a hot rolling treatment at a temperature of 1250° C. After the solid solution treatment at a temperature of 815° C. for an hour, the rolled plate is subjected to a sampling work, and then to an aging treatment at a temperature of 480° C. for three hours.

The following examples are given in order to illustrate the present invention in detail without limiting the same.

EXAMPLE 1

To obtain 35 kg of ingot consisting of 18.5% Ni, 3.0% W, 1.4% Ti, 0.1% Al, and the balance Fe, 6.744 kg of electrolytic nickel, 1.05 kg of tungsten, 0.511 kg of titanium, 52 g of aluminum, and 26.932 kg of electrolytic iron were prepared. First, electrolytic iron and electrolytic nickel were put in a magnesia crucible and then melted under the vacuum of $10^{-3}$ Torr. After the melting of iron and nickel, tungsten, titanium, and aluminum were additionally charged into the crucible. After the completion of melting these alloying elements, argon was blown into the crucible to degass the molten metal. Then, the molten metal was tapped out of the crucible.

After the homogenizing treatment at a temperature of 1250° C. for an hour, the ingot was forged to have the thickness of 30 mm. Then, the forged ingot was hot-rolled at a temperature of 1250° C. to have the thickness of 15 mm for the impact test and the fatigue test, and the thickness of 4 mm for the tension test. The product was maintained at a temperature of 1250° C. for an hour prior to the final rolling thereof and water-cooled just after the rolling thereof to prevent the precipitation of Ti(C,N) at the grain boundary of prior austenite, and thus to obtain a high toughness.

After the solid solution treatment at a temperature of 815° C. for an hour, the rolled plate was subjected to a sampling work for preparing pieces for the tension test, the impact test, and the fatigue test. The obtained samples were aged at a temperature of 480° C. for three hours by using a chloride bath (NaCl: $CaCl_2$=1:1), in order to protect the surfaces of samples from the oxidation and to provide an accuracy of the heat treatment. Thereafter, the mechanical properties of samples were measured. At a result, 1600 Mpa of the yield strength, 1650 Mpa of the tensile strength, 8% of the elongation percentage, and 26 Joule of the charpy impact energy were obtained. All samples for the tension test, the impact test, and the fatigue test were sampled in a direction parallel to the rolling direction. The sample for the tension test were prepared to have a shape of plate according to KS B 0801 (the test piece for the tension of metals). The sample for the impact test were prepared according to KS B 0809 (the test piece for the impact of metals).

EXAMPLE 2

To obtain 35 kg of ingot consisting of 18.5% Ni, 4.5% W, 1.4% Ti, 0.1% Al, and the balance Fe, 6.744 kg of electrolytic nickel, 1.575 kg of tungsten, 0.511 kg of titanium, 52 g of aluminum, and 26.407 kg of electrolytic iron were prepared. The melting, foreging, rolling, and heat treating procedures were identical to those of the above-mentioned example 1. As a result of testing, 1700 Mpa of the yield strength, 1750 Mpa of the tensile strength, 8% of the elongation percentage, and 24 Joule of the Charpy impact energy were obtained.

EXAMPLE 3

To obtain 35 kg of ingot consisting of 18.5% Ni, 6.0% W, 1.4% Ti, 0.1% Al, and the balance Fe, 6.744 kg of electrolytic nickel, 2.010 kg of tungesten, 0.511 kg of titanium, 52 g of aluminum, and 25.882 kg of electrolytic iron were prepared. After the testing, 1850 Mpa of the yield strength, 1900 Mpa of the tensile strength, 7% of the elongation percentage, and 20 Joule of the charpy impact energy were obtained.

Figure 3:
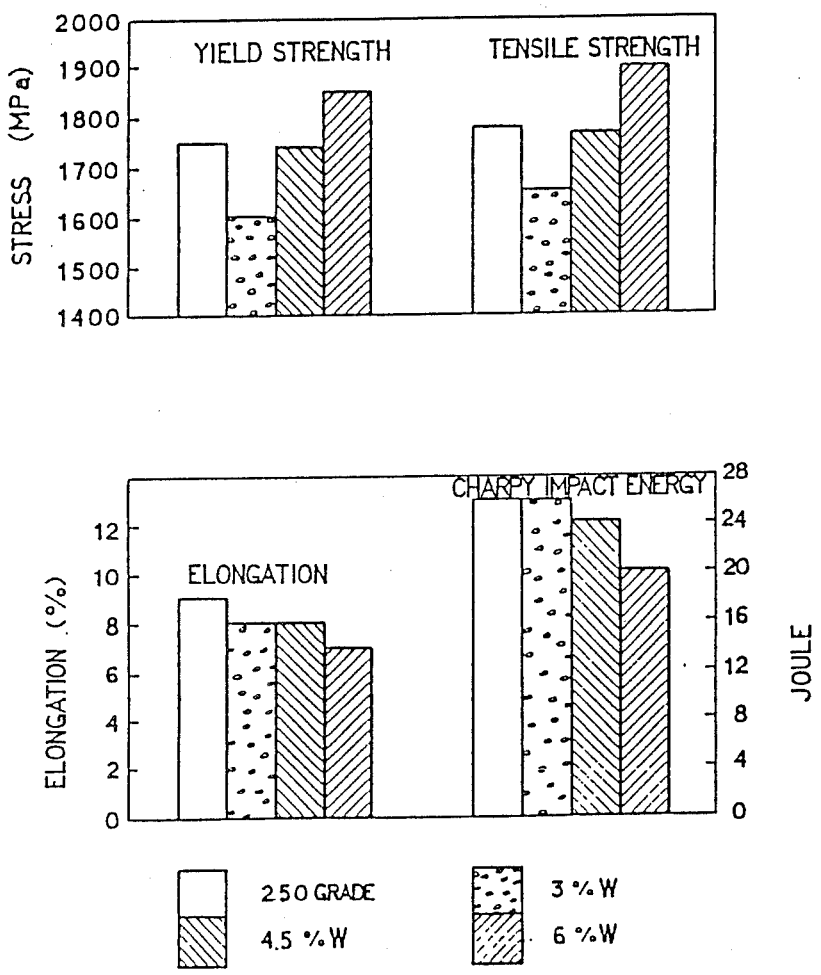
FIG. 3 is graphs showing the variation of mechanical properties of the present maraging steel depending upon the variation of the content of tungsten in said steel.

FIG. 3 shows the variation of mechanical properties as the content of tungsten changes from 3% to 6%. By referring to FIG. 3, it can be understood that 4.5% tungsten-containing maraging steel exhibits the mechanical properties similar to those of conventional 250 grade maraging steel containing cobalt, which exhibits 1750 Mpa of the yield strength, 1800 Mpa of the tensile strength, 9% of the elongation percentage, and 26 Joule of the charpy impact energy. As compared with said 250 grade-maraging steel, the maraging steel of the present invention is advantageously inexpensive in view of the fact that expensive colbalt and molybdenum are eliminated.

Each composition of maraging steels according to the present invention and conventional maraging steel is indicated in the following table.

TABLE (Chemical composition of maraging steel)

| | Ni | Co | Mo | W | Ti | Al | C(max) | Fe |
|---|---|---|---|---|---|---|---|---|
| 3-W | 18.5 | — | — | 3.0 | 1.4 | 0.1 | 0.03 | balance |
| 4.5-W | 18.5 | — | — | 4.5 | 1.4 | 0.1 | 0.03 | balance |
| 6-W | 18.5 | — | — | 6.0 | 1.4 | 0.1 | 0.03 | balance |
| 250 grade | 18.5 | 9.0 | 4.8 | . | 0.4 | 0.1 | 0.03 | balance |

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A maraging steel having high strength and high toughness, consisting of 15% to 25% nickel, 2% to 8% tungsten, 0.5% to 2.0% titanium, 0.05% to 0.30% aluminum, and the balance iron.

* * * * *